United States Patent [19]

Williams et al.

[11] 3,939,082

[45] *Feb. 17, 1976

[54] SOAP THICKENED LUBRICANT COMPOSITION

[75] Inventors: Edward S. Williams, Claymont, Del.; William H. Reiland, West Chester, Pa.; John Q. Griffith, III, Claymont, Del.

[73] Assignee: Sun Oil Company of Pennsylvania, Philadelphia, Pa.

[ * ] Notice: The portion of the term of this patent subsequent to Sept. 26, 1989, has been disclaimed.

[22] Filed: June 10, 1974

[21] Appl. No.: 477,872

Related U.S. Application Data

[63] Continuation-in-part of Ser. No. 178,479, Sept. 7, 1971, Pat. No. 3,816,316, which is a continuation-in-part of Ser. No. 34,899, May 5, 1970, Pat. No. 3,694,363.

[52] U.S. Cl. ..... 252/32.7 E; 252/33; 252/35; 252/41; 252/72

[51] Int. Cl.[2]. C10M 1/48; C10M 3/42; C10M 5/24; C10M 7/46

[58] Field of Search ..... 252/35, 41, 32.7 E, 72, 252/33

[56] References Cited

UNITED STATES PATENTS 3,694,363 9/1972 Griffith et al. ..... 252/41

3,816,316 6/1974 Griffith et al. ..... 252/41

*Primary Examiner*—Delbert E. Gantz
*Assistant Examiner*—I. Vaughn
*Attorney, Agent, or Firm*—George L. Church; Donald R. Johnson; J. Edward Hess

[57] ABSTRACT

An improved gel-thickened lubricant, useful as a gear oil or as an antileak hydraulic oil, comprises an effective amount of a lithium soap (e.g., 0.1 to 1 percent lithium stearate) or an aluminum soap (e.g., 0.5 to 2 percent aluminum stearate), or mixtures of such soaps, and a base oil having a viscosity in the range of 70 to about 3,000 SUS at 100°F (preferably with an aniline point in the range of 150° to 170°F when the oil is to be in contact with Buna N, etc., rubbers), said base oil comprising at least one hydrorefined naphthenic oil or a hydrocracked paraffinic oil having a viscosity in the range of 40 to 12,000 SUS at 100°F. Preferably, the base oil comprises a major amount of the hydrorefined naphthenic oil and a minor amount of a solvent refined paraffinic lube, or a hydrocracked lube with a paraffinic VGC, or a bright stock, or a mixture of two or more such oils. Preferably, the basic nitrogen content of the base oil is less than 80 ppm, more preferred less than 30 ppm (typically 0 to 10 ppm).

12 Claims, No Drawings

SOAP THICKENED LUBRICANT COMPOSITION

CROSS REFERENCE TO RELATED APPLICATIONS

This application is a continuation-in-part of our application Ser. No. 178,479 filed Sept. 7, 1971 (now U.S. Pat. No. 3,816,316 issued June 11, 1974), which is a continuation-in-part of Ser. No. 34,899 filed May 5, 1970 (now U.S. Pat. No. 3,694,363 issued Sept. 26, 1972). The entire disclosure of both of these parent applications is hereby incorporated herein.

The following patents and applications are related to the disclosure of the present application in that they disclose methods of obtaining soap thickened lubricants, aromatic extracts and concentrates, distillate oils, hydrocracked oils and hydrorefined oils, which can be used to make the lubricant composition of the present invention:

U.S. Pat. Nos. 3,383,312, 3,462,358, 3,681,279, 3,502,567, Ser. No. 730,999 filed May 22, 1968, U.S. Pat. No. 3,619,414, Ser. No. 850,716 and Ser. No. 850,717 both filed Aug. 18, 1969 (both now abandoned), U.S. Pat. No. 3,654,127, Ser. No. 873,008 filed Oct. 31, 1969 (now abandoned), U.S. Pat. No. 3,706,653, U.S. Pat. No. 3,673,078, U.S. Pat. No. 3,681,233, Ser. No. 35,231 filed May 6, 1970, Ser. No. 60,642 filed Aug. 2, 1970 (now abandoned), U.S. Pat. Nos. 3,715,302, 3,732,154, 3,663,427, 3,666,657, Ser. No. 140,398 filed May 5, 1971 (now abondoned), U.S. Pat. No. 3,759,817, Ser. No. 178,193 filed Sept. 7, 1971, U.S. Pat. No. 3,791,959, Ser. No. 228,832 filed Feb. 24, 1972, Ser. No. 298,126 filed Oct. 6, 1972 and Ser. No. 440,615 filed Feb. 7, 1974. The disclosure of all of these applications and patents is hereby incorporated in the present application.

BACKGROUND OF THE INVENTION

The industrial oil market is continuing to grow at a rapid pace. Accompanying this growth is the demand for better lubricant properties, due to more severe operating conditions and the need for better pollution control. Wear-resistant oils and heavy duty, antileak industrial gear oils can alleviate the equipment problems and failures caused by increased pressures and temperatures, shock loading, reduced tolerances, etc. Antileak oils can decrease the undesirable loss of lubricants both in closed hydraulic systems and in open gears. Not only do these latter oils reduce consumption, but they help curb the pollution of our natural waters.

This invention is primarily concerned with one specific area, that of antileak lubricants. By reducing leakage at the source, waste oil can be greatly minimized. However, other properties must not be sacrificed to the degree that lubrication and machinery protection are not satisfactory [see "Cutting Fluids", Lubrication 42 (4), 49 to 60 (1956)]. The present antileak lubricants help control pollution and are also completely satisfactory from the standpoint of other performance requirements (e.g., oxidation stability). With respect to oxidation stability, the degree of stability which is obtained by oxidation inhibitor additives (such as the amine, phenolic and metal dithiophosphate additives), is governed by the end use of the lubricant, e.g., gear oils generally require a lower additive concentration than do hydraulic oils). In any event, the present invention provides improved stability, at a given level of a given additive, compared to similar prior art lubricants.

SUMMARY OF THE INVENTION

An improved antileak lubricant of the gel-thickened type comprises an effective amount of a lithium soap (e.g., 0.1 to 1 percent lithium stearate) or an aluminum soap (e.g., 0.5 to 2 percent aluminum stearate), or mixtures of such soaps, and a base oil having a viscosity in the range of 70 to about 3,000 SUS at 100°F, said base oil comprising at least one hydrorefined naphthenic oil or a hydrocracked oil having a viscosity in the range of 40 to 12,000 SUS at 100°F. A preferred base stock is a blend of the hydrorefined naphthenic oil and at least one paraffinic, by viscosity-gravity constant (VGC), lube which can be solvent refined, hydrocracked or a bright stock. The lubricant can also contain one or more of the following: an antirust agent (e.g., 0.02 to 2 percent, typically 0.2 percent barium petroleum sulfonate), an antioxidant (e.g., 0.05 to 1 percent of an amine type), an antifoam (e.g., 0.05 to 1 percent of a silicone type) and an antiwear (e.g., 0.1 to 5 percent, typically 0.3 to 2 percent, zinc dialkyldithiophosphate, such as zinc-isopropyl, decyldithiophosphate) or tricresylphosphate. For systems having seals comprising synthetic rubbers (e.g., "Buna N", GRS, ABS) it is preferred that the aniline point of the base oil be in the range of 150 to 170°F. For systems where the seals are of other rubbers or materials, a higher aniline point may be required (e.g., for the silicone rubbers an aniline point of about 200°F imparts the proper seal-swelling character to the hydraulic oil). In calculation of the aniline point of the base oil, one must consider the contribution of aromatic additives (e.g., those marketed as seal swell agents) and the hydrocarbon diluent used in many commercial additives. The term "base oil" in the present application refers to the total hydrocarbons of the 40 to 12,000 SUS vicinity range which are present in the final hydraulic oil, it being understood that some of these hydrocarbons can be contributed via the usual commercial additives.

A preferred antioxidant is DBPC (ditertiarybutyl paracresol) or an amine type, used in combination with sufficient zinc dialkyldithiophosphate to impart antiwear properties (e.g., 0.010 to 0.20 percent zinc). Such dialkyldithiophosphates can also provide improved oxidation resistance.

The lubricant can show good antiwear and antileak performance and good hydrolytic and oxidation stability in the ASTM D-943 turbine oil stability test (TOST).

The base oils preferably contain less than 80 ppm of basic nitrogen and can be those described in the previously cited applications and patents of Mills et al. and, more preferably, are blends of two or more hydrorefined naphthenic oils (e.g., a blend of a 100 SUS at 100°F hydrorefined naphthenic oil and a 2,500 SUS at 100°F hydrorefined naphthenic oil) and hydrocracked paraffinic oil or of hydrorefined naphthenic oil and a paraffinic bright stock.

For hydraulic oil usage, leakage reduction is achieved by designing into the lubricant the ability to maintain good rubber seal condition (e.g., by proper choice of aniline point of the base oil) and the ability to obstruct small leaks with retardant materials (e.g., lithium or aluminum soaps or polymers). Plant trials have been conducted comparing the performance of the antileak hydraulic oils of the present invention to current, standard products. Lubricant loss was lowered as much as 88 percent by the leak resistant formulations. These antileak hydraulic oils of the present invention also have good over-all properties and have performed well in many types of plant equipment.

FURTHER DESCRIPTION

The hydrocarbon base oil can also contain a low nitrogen content paraffinic distillate or solvent raffinate oil, a hydrorefined paraffinic distillate or raffinate, a viscosity index improver (e.g., high molecular weight polybutene or a polyacrylate or polymethylacrylate, preferably the dispersant type), a polycyclic aromatic concentrate (such as cycle stock) or extract (such as a furfural extract from a naphthenic distillate) to adjust the 335 UVA of the base stock (which preferably is in the range of 0.01 to 0.4, more preferred 0.02 to 0.2) and/or the aniline point and an unhydrorefined naphthenic distillate or a naphthenic acid-free naphthenic distillate (to improve the D-943 test performance).

Paraffinic oils, whatever their refining history (e.g., hydrocracking), are those having a viscosity-gravity constant (VGC) in the range of 0.790 to 0.819 (preferably above 0.799).

Naphthenic oils have a VGC in the range of 0.820 to 0.899 and the preferred hydrorefined naphthenic oils have a VGC in the range of 0.840 to 0.899. Hydrorefined, relatively aromatic oils, having a VGC in the range of 0.900 to 0.920, can sometimes be used as a whole or partial substitute for the hydrorefined naphthenic lube. Aromatic oils (including hydrorefined or hydroaromaticized oils) having a VGC in the range of 0.921 to 1.050 and greater, can be useful in minor proportions (e.g., 1 to 20 percent) for adjusting the aniline point of the base oil, particularly when the base oil contains a high proportion of a high VI hydrocracked paraffinic oil.

As an additional component, or as a partial or complete substitute for the hydrorefined naphthenic oils previously described, hydraulic oils of the gel or polymer thickened types can contain a wax-free, hydrogenated polyolefin oil (e.g., see Canadian Pat. No. 842,290; U.S. Pat. No. 3,598,740) or a high viscosity index, hydrocracked oil or a mixture of such components. In such blends an aromatic oil or concentrate rich in aromatic hydrocarbons (e.g., cycle oil) may have to be added to obtain the proper aniline point for seal swelling.

The preferred polyolefin oils are polymers or copolymers of $C_2$ to $C_8$ olefin which have a pour point no greater than −35°F, and preferably below −50°F. The hydrogenation can be from 50 to 100 percent of saturation and, preferably, is to a bromine number no greater than 10, more preferably less than 5. Preferred polyolefins include ethylene-propylene copolymer, polypropylene, polybutene (especially polyisobutylene), and poly(1-octene).

The high VI hydrocracked paraffinic oil component can be obtained by hydrocracking a high viscosity distillate or dewaxed distillate from a paraffinic or naphthenic crude (such as Lagomedio) and typically has a VI in the range of 90 to 105 and contains in the range of 3 to 30 percent of aromatics by clay-gel analysis. The hydrocracked lubes are preferably stabilized (against UV light degradation and sludging) by extraction of the hydrocracked oil with aromatic selective solvents, such as furfural or phenol or by hydrorefining to reduce the 260 UVA at least 30 percent (preferably 40 percent).

The preferred "stabilized" hydrocracked oils (whether extracted or hydrorefined) are characterized by having a D-943 test life (to an increase in acid number of 2.0) which is at least 20 percent lower than the D-943 life of an unstabilized hydrocracked oil but which is at least 20 percent greater than the D-943 life (with the usual amount of inhibitor) of an unhydrocracked solvent refined lube of the same viscosity.

One process for preparing a high VI hydrocracked oil comprises fractionating the stock material (such as an atmospheric residuum from Lagomedio crude) into three fractions, boiling at (a) from 720° to 855°F, (b) 855° to 980°F and (c) the residuum or a fraction boiling at from 986° to 1070°F, solvent extracting fraction (b) with a solvent having preferential solubility for aromatics such as furfural, recombining the three fractions, dewaxing to 0°F pour point or lower, and hydrocracking the combined fractions at from 720° to 800°F using a hydrogen partial pressure of from 2,000 to 3,000 psi, and a sulfided nickel-tungsten catalyst supported on silica-alumina and containing a minor amount of a fluoride (e.g., Gulf GC-6). The higher boiling fraction is deasphalted if required.

Examples of such hydrocracked oils are found in U.S. 3,579,435 and in the following applications (the disclosure of which is incorporated herein by reference):

| Serial No. | Filed | Inventor(s) | Patent No. | Issued |
|---|---|---|---|---|
| 780,241 | 11-19-68 | Thompson et al. | 3,617,484 | 11-2-71 |
| 875,502 | 11-10-69 | Thompson | abandoned | |
| 64,656 | 8-17-70 | Kress | 3,723,295 | 3-27-73 |

The preferred amount of gelling agent to add to a given base oil can be determined from an experimentally obtained "soap in oil curve". That is, various amounts of soap are added to base oil samples (which can also include some or all of the other additives) and the viscosity of the soap-oil samples is determined. The results are plotted as a viscosity versus concentration curve. In such a curve, a point will be found where the viscosity suddenly increases greatly. This will be the minimum concentration of soap which should be put into the oil for antileak protection. Generally, about 0.1 percent more soap than this minimum concentration should be put into the oil. The maximum amount of soap (or other gelling agent) will be where the solution "lumps-up" or becomes non-homogeneous.

The preferred soaps are lithium or aluminum stearate; however, any of the prior art lithium or aluminum soaps which have been used in petroleum lubricants can be useful in hydraulic oils of the present invention. Such soaps are shown, for example, in U.S. Pat. Nos. 2,489,300 and 3,383,312. For soap thickening useful lithium or aluminum soaps include soaps of fatty acids containing in the range of 12 to 22 carbon atoms, preferably an unsubstituted fatty acid. Stearates, palmitates, tallates, laurates, oleates and mixed soaps are among the useful soaps.

Polymer thickened oils can contain a small amount of a soap as a dispersant for the polymer or as a stabilizer (see U.S. Pat. No. 2,489,300). The present oils can also contain both soap and a polymer as long as the soap concentration is sufficient to contribute to thickening (e.g., 0.1 to 2 weight percent).

To reduce equipment leakage, it is important that elastomeric seals and gaskets maintain a slight positive swell and remain pliable. Shrinkage and hardening allow oil to bypass. Certain base oils can help to keep the seals working properly.

A good test for judging if a base stock will properly condition the most commonly used seals, i.e., Buna N and Neoprene, is the aniline point (ASTM D-611). This test measures the solubility temperature of aniline and the lubricant. The aniline point is, therefore, a measure of solvency of the lubricant. Data obtained for the percent swell for Buna N and Neoprene seals for a series of 250 SUS at 100°F oils having aniline points ranging from 150°F to 230°F show, that to obtain a small positive swell with the seals tested, the base oil should have an aniline point between 150° and 170°F. Lubricants which are mostly paraffinic in structure have high aniline points and will shrink the rubber and make it hard. This permits the lubricant to leak. On the other hand, if the aniline point is below 150°F, excessive swell often occurs and the seal may be cut and torn by the rubbing surface, thereby allowing lubricant to bypass. This correlation does not necessarily apply to lubricants which contain seal conditioning additives. For other rubbers, such as silicones, a different aniline point range may be required for proper swelling (e.g., for silicone rubbers an aniline point in the range of 195° to 215°F is preferred.

Note that such prior art as U.S. Pat. No. 2,408,983 (which at column 5 shows an aniline point of 178°F), U.S. Pat. No. 2,489,300 (which in examples 1 and 2 shows aniline points of 145°F and 131°F) and U.S. 2,616,854 (which shows a range of 175° to 190°F) lead the art away from our preferred ranges of 150° to 170°F and 195° to 215°F.

Besides utilizing a base oil which properly conditions the rubber seals and gaskets, leakage can also be reduced by restricting small openings with leak retardant materials. The leak retardant must be carefully selected so that the properties of the lubricant are not harmed. There are two basic types of antileak additives presently being used. The first is the polymeric type which includes material having molecular weights greater than several hundred thousand (e.g., polybutene). The second involves gelling agents (e.g., organic salts of polyvalent metals or "soaps") which can have molecular weights of about three hundred.

There are no known products which completely stop leakage. One reason for this is that the types of leak retardants which can be used are limited by other performance characteristics. The antileak component must be a material which will not cause plugging in filters as small as five microns or interfere with servovalve operation where clearances are extremely critical. Other properties of the lubricant itself, such as the oxidation stability, foam resistance, etc., must not be sacrificed.

In the following examples, as in the rest of this application, all percentages are by weight.

ILLUSTRATIVE EXAMPLES

The best way to evaluate new formulations is in the actual machinery in which leak problems are encountered. There is presently no standard way to measure antileak properties in the laboratory. A laboratory method has been devised, however, which appears to correlate with field experience. This test has been useful in measuring good versus bad antileak oils or improvements over a given reference oil. The reference oil can be, for example, a rust and oxidation (R&O) inhibited paraffinic hydraulic oil. This R&O reference contains all of the necessary additives to guarantee good lubricant performance but incorporates no leak retardants.

The apparatus in which leakage characteristics are measured is a U-shaped combination of ¾-inch iron nipples, union sleeves, and elbows. They are joined together by hand tightening in a U-shape and then spot welded to hold in a fixed position. One end of the U is capped, the other end is connected to a pressure source. The procedure utilizes a 300 cc oil sample. The system is pressurized to 30 psi with nitrogen and allowed to stand for one hour. The oil which has dripped out at the end of this period is collected and weighed.

As with most screening tests, this method can only predict whether the oil is better than another. It cannot indicate the degree of improvement to be provided. Nothing but a large amount of field experience can supply this information.

EXAMPLE 1

Polymeric Type Antileak Hydraulic Oils

The incorporation of suitable polymers into hydraulic oils at concentrations as high as five percent can provide leakage protection. As can be seen in Table I, a typical product containing a high molecular weight butene polymer also has good over-all properties. The base oils, which are naphthenic in nature, have an aniline point of 152°F and generally provide good rubber seal conditioning. Water separation, foam resistance, rust protection are all acceptable. The oxidation stability, as measured by the ASTM D-943 procedure, is 1,250 hours. Leakage resistance, according to the laboratory test is approximately 41 percent less than that of a normal R&O hydraulic oil.

Two field trials were run with the polymeric antileak hydraulic oil. The results of these equipment evaluations are listed in Table II. In the first field trial listed, three broaches were run for a period of two months at each of three separate plant locations. The broaches were first run with the R&O hydraulic oil to determine baseline data. The polymeric antileak oil was then added to these same machines and consumption characteristics measured. As can be seen, the three divisions reported improvements of 46, 88 and 50 percent, respectively. The second trial listed in Table II was run on a total plant basis. All machines using R&O hydraulic oil were studied for consumption during a six month period. These same machines were then charged with the polymeric antileak hydraulic oil for an equivalent six month period. After the one year trial, this plant measured a reduction in lubricant consumption of 38 percent. Table III lists twelve machines in the second plant trial which had the largest amount of leakage with the B&O type hydraulic oil. The machines covered a wide range of operations. In these pieces of equipment, the leakage reduction afforded by the polymeric antileak hydraulic oil was 39 percent, significantly more than the percentage reported for the total plant. Good leakage reduction is obtained with one to 6 percent polybutene (typically 2 percent).

The polymeric antileak lubricant after the field trials had experienced only the normal amount of degradation. Filter and valve operations were completely satisfactory. The one final property which had changed more than that of the R&O hydraulic oil was viscosity. The polymer loss by sheardown caused a viscosity decrease of approximately 10 percent. This loss did not cause any performance problems.

A polymer thickened antileak oil with good performance in the D-943 test comprises 2 percent of a polybutene additive, 0.6 percent DBPC, 0.7 percent zinc dialkyldithiophosphate and the remainder a blend of hydrorefined naphthenic oil and hydrocracked paraffinic oil, the blend having an aniline point of 200°F and a viscosity at 100°F of 300 SUS.

EXAMPLE 2

Gel Type Antileak Hydraulic Oils

An antileak hydraulic oil was compounded using lithium stearate as a gel type leak retardant.

The gel type antileak hydraulic oil composition had a SUS viscosity of about 250 at 100°F and was prepared from a 200 SUS (at 100°F) base oil containing 56 ppm of basic nitrogen and obtained by blending 25 percent of 2,400 SUS (at 100°F) hydrorefined naphthenic oil and 75 percent of 100 SUS (at 100°F) hydrorefined naphthenic oil. Both hydrorefined naphthenic oils were obtained from naphthenic acid-free naphthenic distillate by hydrogenation at 625°F, 1,200 psig of 80 percent hydrogen, 0.2 LHSV with a presulfided nickel-molybdenum-oxide catalyst. In addition to the base oil, the hydraulic oil contained 0.25 percent lithium stearate, 0.17 percent of an amine type antioxidant (DuPont Ortholeum), 10 ppm of a defoamer (Dow Corning Silicone), 0.2 percent of a neutral barium petroleum sulfonate antirust agent, and 0.7 percent zinc dialkyldithiophosphate (Elco 114). The zinc dialkyldithiophosphate imparts especially useful antiwear and antioxidant properties to the hydraulic fluid and has excellent hydrolytic stability. The alkyl group of this additive can vary considerably, depending on the manufacturer; however, all such presently commercially available zinc dialkyldithiophosphate antiwear additives can be used in the fluids of the present invention.

Specific gelling agents (e.g., lithium or aluminum soaps) appear to be more efficient than the polymers in reducing leakage at concentrations up to three percent. The aluminum soaps are less hydrolytically stable than the lithium soaps. Lubricants containing these materials are, however, also somewhat less stable to oxidation. The over-all properties of the gel thickened hydraulic oil are good. A hydrogenated naphthenic type blended base oil with an aniline point of 160°F, for example, can be used to provide seal swell. Oxidation stability, as measured by the ASTM D-943 procedure, is about 300 hours less than the polymeric version but about 200 percent better than a comparable oil containing naphthenic acid-free naphthenic distillate instead of the hydrorefined oil. The leak resistance of the gel type oil made from the hydrorefined base stock is twice as good as measured in laboratory equipment.

Field trial data was obtained with the gel anti-leak hydraulic oil of this example. Three presses were tested, one a horizontal type, and the other two vertical. These presses were operated from 880 hours to 1,944 hours. Leakage reduction when compared to the R&O hydraulic oil was 55, 85 and 60 percent, respectively. These values are higher than the reductions reported for the polymeric antileak hydraulic oil. Filter and valve performance were completely acceptable. After this trial the condition of the product was excellent. There was no significant viscosity or acid buildup. A viscosity loss of about 15 percent occurred due to the sheardown of the gel, but there was still enough of the leak retardant present to maintain good leakage reduction.

Actual equipment testing has shown the polymeric antileak hydraulic oils can reduce losses by 23 to 88 percent. The gel containing antileak hydraulic oils are more efficient with reductions of 55 to 85 percent in plant equipment.

EXAMPLE 3

An antileak hydraulic oil was compounded using the same blended (i.e., 100 SUS and 2,400 SUS hydrorefined naphthenic oils) base oil as in Example 2; however, the additives were different from those in Example 2, namely, 0.7 percent ditertiarybutyl paracresol (DBPC), 0.05 percent alkyl $C_8$ to $C_{18}$) substituted succinic acid (Lubrizol 850), 0.1 percent dioctyldithiothia-diazole (Amoco 150), 2 ppm silicone defoamer (1,000 cSt at 100°F, Dow Corning 200 fluid). This hydraulic oil required about 1,000 hours of ASTM D-943 testing to reach an acid number end point of 2.0. In contrast, a hydraulic fluid with the same additives but made from unhydrorefined naphthenic oil failed after 200 hours of D-943 testing.

Addition of zinc dialkyldithiophosphate to provide 0.15 percent zinc in the final compounded oil imparts good antiwear properties.

EXAMPLE 4

Two antileak hydraulic oils were compounded using the additives in Example 3 (that is, one oil contained zinc dialkyldithiophosphate) and as the base oil a 200 SUS blend of a 100 SUS hydrocracked paraffinic lube. Both oils showed better D-943 test performance than the corresponding oils containing hydrorefined or unhydrorefined base oils.

EXAMPLE 5

An antileak hydraulic oil was compounded using the same amount of lithium stearate and the same base as in Example 1. The addition of five percent of a 200 SUS "DuoSol" extracted paraffinic lube having an aniline point of 226°F improved the D-943 performance of the hydraulic oil. Similar results were obtained with five percent of a 152°F aniline point blend of 25 percent 100 SUS and 75 percent 2,500 SUS naphthenic acid-free naphthenic distillates or with two and one-half percent of the paraffinic oil and two and one-half percent of the naphthenic oil blend.

A 200 SUS hydrocracked paraffinic lube can be used instead of the paraffinic lube in this example.

EXAMPLE 6

An antileak heavy duty gear oil was made by blending the following:

| | Volume Percent |
|---|---|
| Bright Stock* (150 SUS at 100°F) | 71.00 |
| Hydrorefined Naphthenic Lube (2,400 SUS at 100°F) | 24.75 |
| Lithium Stearate | 0.25 |
| Dow Corning Silicone Antifoam | |

-continued

| | Volume Percent |
|---|---|
| (one percent active) | 0.50 |
| Lubrizol 5002** | 3.50 |

*VGC of 0.79, ASTM VI of 97, obtained from solvent refining of paraffinic distillate.
**Commercial gear oil additive of the phosphorus-sulfur type providing antiwear, antirust and antioxidant.

The blending is conventional. All components blended should be at relatively the same temperature at the start. Only mechanical agitation should be used. Moisture must not be present in the blending vessel or in the final packaging containers. Heating of the components, while mechanically agitating, should not exceed 150°F.

Table VI reports certain properties of a typical batch of this blended gear oil and the usual range of batch to batch manufacturing variability.

The attached Table VIII lists the properties of a series of hydrocracked oils (stabilized by solvent extraction) which are especially suitable components for blending with hydrogenated and/or unhydrogenated naphthenic oils and/or an aromatic concentrate to provide a suitable base stock having an aniline point in the range of 150° to 170°F. For such blending, the following formula can be used to predict the aniline point (AP) of the blended base stock (AP Base): AP Base = (X)(AP Paraffinic Component) + (1-X)(AP Naphthenic Component); where X is the volume fraction of the paraffinic component and 1-X is the volume fraction of the naphthenic component.

An especially useful blended paraffinic component is obtained by blending 90 parts by volume of a 60 SUS at 100°F hydrocracked paraffinic oil (obtained by Duo-Sol extraction of a paraffinic distillate) with 10 parts by volume of the unhydrorefined paraffinic oil (obtained by Duo-Sol extraction of a paraffinic distillate).

Another paraffinic component, which can also be used as a textile process oil (due, in part, to its high unsulfonatable residue), is obtained by substitution o the hydrocracked paraffinic oil for the solvent refined oil. Similar paraffinic components of higher viscosity and differing aniline points can be obtained by blending other hydrorefined and unhydrorefined paraffinic lube stocks of higher viscosity.

Some commercial additive packages contain aromatic compounds. The contribution of these aromatics to the aniline point of the base oil must be considered in calculations.

When the base oil contains a hydrocracked oil component, satisfactory seal swelling can be obtained at higher aniline points (e.g., about 200°F).

An especially useful soap and polymer thickened oil, for lubrication of textile machinery, can be made by adding lithium stearate (or lithium palmitate, laurate, oleate, etc.) and high molecular weight polyisobutylene to a hydrogenated naphthenic oil having a viscosity in the range of 60 to 300 SUS at 100°F. For example, sufficient lithium stearate (0.7 percent) and polyisobutylene (1.9 percent Paratec) to produce a MacMichael viscosity of about 25 was added to a 150 SUS (at 100°F) hydrorefined naphthenic lube (aniline point 162) to which there was also added 1.3 percent of 40 percent chlorinated paraffin (Chlorfin 40), to improve load carryability of the oil, 0.4 of ditertiarybutyl paracresol and 2 ppm of a silicone antifoam. This lithium soap thickened textile lubricant cannot be made with a paraffinic base oil of the same viscosity since the paraffinic oil is not sufficiently compatible with soap to permit attainment of the desired MacMichael viscosity. Unhydrorefined naphthenic oil cannot be used in this oil because it causes discoloration and damage to textiles.

The soap thickened, antileak hydraulic oils described herein can be used as a functional fluid in energy adsorber devices, such as those which can reduce the body and bumper damage caused by automotive collisions (e.g., see Publications 710536, 710537 and 710540 of the Society of Automotive Engineers; mid-year meeting, Montreal, Quebec, Canada, June 7 to 11, 1971. In such a combination the base oil should have an aniline point of about 200°F when the seals are of silicone rubber.

In this application, hydrocracking is distinguished from hydrorefining in that in a hydrorefining process the production of "overhead" (i.e., hydrocarbons boiling below 485°F) is less than 25 percent by volume per pass through the reactor (and, typically less than 10 percent), see, for example, Ser. No. 228,832 filed Feb. 24, 1972 now U.S. Pat. No. 3,839,188 issued Oct. 1, 1974.

An aluminum "complex" soap concentrate, which is useful in the present invention, can be made as follows (all parts are by weight):

Dissolve 0.7 parts benzoic acid in 500 parts of bright stock (or other high viscosity lube) at 220°F.

Dissolve 13 parts stearic acid in 450 parts of paraffinic bright stock (or other high viscosity lube) at 200°F.

Add Agrashell Kolate, 3 parts, to the stearic acid in oil, mix and stir (e.g., about eight minutes).

Add the benzoic acid in oil to the stearic-acid-oil-Kolate, heat with stirring, to 400°F, then cool with stirring to 220°F.

The concentrate is especially useful at levels which impart 0.1 to 1 percent aluminum complex soap to the final hydraulic oil composition.

Agrashell Kelate is a reactive oxoaluminum compound for making complex alumimum soaps and greases.

TABLE I

Polymeric Type Antileak Hydraulic Oil Lubricant Properties

| Test | ASTM Method | R&O Hydraulic Oil | Antileak Hydraulic Oil |
|---|---|---|---|
| Viscosity, SUS/100°F. | D2161 | 250 | 242 |
| Viscosity, SUS/210°F. | D2161 | 50.4 | 45.3 |
| Viscosity, Index | D2270 | 102 | 34 |
| Viscosity, cs/100°F. | D445 | 53.9 | 52.1 |
| Viscosity, cs/210°F. | D445 | 7.4 | 5.82 |
| Flash, COC, °F. | D92 | 440 | 335 |
| Fire, COC, °F. | D92 | 495 | 385 |
| Pour, °F. | D97 | 0 | −25 |
| Color | D1500 | 2.0 | 2.25 |

TABLE I-continued

| Test | ASTM Method | R&O Hydraulic Oil | Antileak Hydraulic Oil |
|---|---|---|---|
| Polymeric Type Antileak Hydraulic Oil Lubricant Properties | | | |
| Gravity, °API | D287 | 31.2 | 21.2 |
| TAN, mgKOH/g | D664 | 0.07 | 0.0 |
| Copper Strip, class | D130 | 1 | 1 |
| Aniline Point, °F. | D611 | 230 | 152 |
| Demulsibility/130°F. | D1401 | 10 | 20 |
| Separation, min. | | | |
| Foam, Tendency/Stability | D892 | | |
| Sequence I, ml | | 20/0 | 5/0 |
| Sequence II, ml | | 20/0 | 25/0 |
| Sequence III, ml | | 20/0 | 20/0 |
| Rust, Syn Sea Water | D665B | Pass | Pass |
| Oxidation Stability, hr[1] | D943 | 1,300 | 1,250 |
| Leak Resistance | — | | |
| Gms Leaked | | 110 | 65 |
| Reduction, % | | — | 41 |

[1]To 2.0 TAN end point.

TABLE II

| | Consumption, Gallons R&O Hydraulic Oil | Antileak Hydraulic Oil | % Reduction |
|---|---|---|---|
| Polymeric Type Antileak Hydraulic Oil Plant Trial Data | | | |
| No. 1 Plant Trial | | | |
| Per broach per week* at | | | |
| Division A | 5.7 | 3.1 | 46 |
| Division B | 23.1 | 2.7 | 88 |
| Division C | 10.0 | 5.0 | 50 |
| No. 2 Plant Trial | | | |
| Total plant usage** | 3,131,667 | 2,242,766 | 28 |
| Per unit manufactured | .98 | .75 | 24 |

* 2 month duration
** 6 month duration

TABLE III

| Type Equipment | Average Weekly Consumption, Gallons R&O Hydraulic Oil | Antileak Hydraulic Oil |
|---|---|---|
| Polymeric Antileak Hydraulic Oil No. 2 Plant Trial Leakage Comparisons Most Critical Machines | | |
| Broach | 108 | 57 |
| Automated Drill Line | 41 | 33 |
| Mill | 12 | 19 |
| Drill | 217 | 155 |
| Gear Cutter | 140 | 112 |
| Drill | 198 | 35 |
| Lathe | 217 | 178 |
| Broach | 32 | 28 |

TABLE III-continued

| Type Equipment | Average Weekly Consumption, Gallons R&O Hydraulic Oil | Antileak Hydraulic Oil |
|---|---|---|
| Polymeric Antileak Hydraulic Oil No. 2 Plant Trial Leakage Comparisons Most Critical Machines | | |
| Gear Cutter | 102 | 57 |
| Grinder | 28 | 6 |
| Drill | 23 | 16 |
| Lathe | 66 | 25 |
| Total | 1,184 | 721 |
| % Reduction | | 39 |

TABLE IV

| Test | ASTM Method | R&O Hydraulic Oil | Antileak Hydraulic Oil |
|---|---|---|---|
| Polymeric Type Antileak Hydraulic Oil Lubricant Properties | | | |
| Viscosity, SUS/100°F. | D2161 | 250 | 258 |
| Viscosity, SUS/210°F. | D2161 | 50.4 | 45.5 |
| Viscosity, Index | D2270 | 102 | 23 |
| Viscosity, cs/100°F. | D445 | 53.9 | 55.6 |
| Viscosity, cs/210°F. | D445 | 7.4 | 5.9 |
| Flash, COC, °F. | D92 | 440 | 350 |
| Fire, COC, °F. | D92 | 495 | 390 |
| Pour, °F. | D97 | 0 | −40 |
| Color | D1500 | 2.0 | 2.5 |
| Gravity, °API | D287 | 31.2 | 22.1 |
| TAN, mgKOH/g | D664 | 0.07 | 0.0 |
| Copper Strip, class | D130 | 1 | 1 |
| Aniline Point, °F. | D611 | 230 | 160 |
| Demulsibility/130°F. | D1401 | | |
| Separation, min. | | 10 | 25 |
| Foam, Tendency/Stability | D892 | | |
| Sequence I, ml | | 20/0 | 5/0 |
| Sequence II, ml | | 20/0 | 25/0 |
| Sequence III, ml | | 20/0 | 5/0 |
| Rust, Syn Sea Water | D665B | Pass | Pass |
| Oxidation Stability, hr[1] | D943 | 1,300 | 900 |
| Leak Resistance | — | | |

TABLE IV-continued

| Test | Polymeric Type Antileak Hydraulic Oil Lubricant Properties ASTM Method | R&O Hydraulic Oil | Antileak Hydraulic Oil |
|---|---|---|---|
| Gms Leaked | | 110 | 20 |
| Reduction, % | | — | 82 |

[11]To 2.0 TAN end point.

TABLE V

| Gel Type Antileak Hydraulic Oil Plant Trial Data | | | |
|---|---|---|---|
| Equipment | | | |
| Type | Horizontal Press | Vertical Press | Vertical Press |
| Ram Diameter | 12" | 22" | 36" |
| Oil Capacity | 150 gal | 200 gal | 300 gal |
| Operation | | | |
| Pressure | 1500 psi | 1000 psi | 1500 psi |
| Temperature | Ambient | 150°F | 125°F |
| Duration | 880 hr | 1944 hr | 1400 hr |
| Leakage | | | |
| R&O Hydraulic Oil | 75–100 gal/wk | 50 gal/wk | 125 gal/wk |
| Antileak Hydraulic Oil | 35–40 gal/wk | 7 gal/wk | 50 gal/wk |
| Reduction, % | 55–60 | 85 | 60 |

TABLE VI

| Property | ASTM Method | Range Usual | Range | Typical Data |
|---|---|---|---|---|
| Viscosity, SUS/100°F | D-2161 | 2850 | 3150 | 3000 |
| Viscosity, eSt/100°F | D-445 | 615 | 701 | 647 |
| Flash, COC, °F | D-92 | | 475 min | 500 |
| Pour, °F | D-97 | | +5 max | 0 |
| Color | D-1500 | | 6.0 | 5.0 |
| Gravity, °API | D-287 | | 22.5 min | 23.7 |
| pH | | | | 7.0 |
| Total Acid No., mgKOH/g | D-664 | | | 0.60 |
| Copper Strip, class, 3 hours at 212°F | D-130 | | 1 | 1A |
| Foam, Tend/Stab, ml | D-892 | | | |
| Sequence I | | | 100/0 | 50/0 |
| Sequence II | | | 200/0 | 100/0 |
| Sequence III | | | 100/0 | 50/0 |
| Rusting, Distilled $H_2O$ | D-665A | Pass | | Pass |
| Timken, OK Load | D-2782 | | 50 min | 55 |
| Weld Point | | | | 315 |
| 4-Ball Wear, Scar | | | | 0.42 |
| Lithium, percent ppm | | 55 | 75 | 65 |
| Phosphorus, percent | D-1091 | 0.020 | 0.026 | 0.022 |

TABLE VII

| Properties of Hydrocracked Oils* | | | | |
|---|---|---|---|---|
| Viscosity (SUS, 100°F.) | ASTM VI | Gravity API | Wt.% Aromatics | Aniline Point °F. |
| 100 | 103 | 34.2 | 12 | 220 |
| 200 | 107 | 33.3 | 11 | 235 |
| 500 | 107 | 31.5 | 13 | 250 |

*All oils dewaxed to a 0°F. pour point by chilling in a solvent.

The invention claimed is:

1. A soap thickened lubricant comprising an effective amount, for thickening, of a lithium soap of a fatty acid or an aluminum soap of a fatty acid and a hydrocarbon base oil having a viscosity in the range of 80 to about 3,000 SUS at 100°F said base oil comprising at least one hydrorefined naphthenic oil or hydrocracked paraffin oil having a viscosity in the range of 40 to 12,000 SUS at 100°F.

2. A lubricant according to claim 1 and containing at least one said hydrorefined naphthenic oil which contains less than 80 ppm of basic nitrogen and has a viscosity-gravity constant in the range of 0.840 to 0.899.

3. A lubricant according to claim 1 and containing in the range of 0.1 to 1 percent lithium stearate.

4. A lubricant according to claim 1 and wherein said fatty acid has 12 to 22 carbon atoms.

5. A lubricant according to claim 4 and containing in the range of 0.0 to 1 percent lithium stearate, in the range of 0.02 to 2 percent neutral barium petroleum sulfonate and in the range of 0.1 to 5 percent zinc dialkyldithiophosphate.

6. A lubricant according to claim 1 wherein same base oil is a blend of at least two hydrorefined naphthenic oils.

7. A lubricant according to claim 1 wherein said base oil contains said hydrorefined naphthenic oil and at least one additional oil component having a viscosity-gravity constant below 0.819.

8. A lubricant according to claim 7 wherein said additional oil component is selected from bright stock, hydrocracked oil, solvent refined distillate and polyolefin oil.

9. A lubricant according to claim 1 wherein said hydrocracked oil has been stabilized by contact with an aromatic selective solvent after hydrocracking.

10. A lubricant according to claim 1 wherein said base oil contains less than 80 ppm of basic nitrogen.

11. A lubricant according to claim 1 which is useful as a hydraulic oil and wherein said base oil has an aniline point in the range of 150° to 170°F.

12. A lubricant according to claim 1 wherein said base oil contains a hydrocracked paraffinic oil and has an aniline point in the range of 195° to 215°F.

* * * * *